US009380669B2

(12) United States Patent
Chu et al.

(10) Patent No.: US 9,380,669 B2
(45) Date of Patent: Jun. 28, 2016

(54) LOW FLICKER LED DRIVING CIRCUIT WITH HIGH POWER FACTOR

(71) Applicant: VastView Technology Inc., Hsinchu County (TW)

(72) Inventors: Hung-Chi Chu, Hsinchu County (TW); Yuhren Shen, Hsinchu County (TW)

(73) Assignee: VastView Technology Inc., Hsinchu County (TW)

( * ) Notice: Subject to any disclaimer, the term of this patent is extended or adjusted under 35 U.S.C. 154(b) by 180 days.

(21) Appl. No.: 14/297,906

(22) Filed: Jun. 6, 2014

(65) Prior Publication Data

US 2015/0359051 A1 Dec. 10, 2015

(51) Int. Cl.
*H05B 37/02* (2006.01)
*H05B 33/08* (2006.01)

(52) U.S. Cl.
CPC ..... *H05B 33/0845* (2013.01); *H05B 33/083* (2013.01)

(58) Field of Classification Search
USPC ..... 315/185 R, 187, 192, 193, 185 S, 200 R, 315/201, 205, 209 R, 210, 227 R, 228, 240, 315/250, 287, 290, 294, 295, 297, 299, 300, 315/307, 308, 312, 313, 352, 353, 355, 362
See application file for complete search history.

(56) References Cited

U.S. PATENT DOCUMENTS

2005/0218838 A1* 10/2005 Lys ..... F21S 48/325 315/291
2010/0207536 A1* 8/2010 Burdalski ..... H05B 33/0818 315/224
2011/0068706 A1* 3/2011 Otake ..... H05B 33/0815 315/291
2011/0199023 A1* 8/2011 Zimmermann .... H05B 33/0818 315/297
2013/0141017 A1* 6/2013 Esaki ..... H05B 33/0815 315/307
2014/0042925 A1* 2/2014 Wang ..... H05B 33/083 315/232

* cited by examiner

*Primary Examiner* — Douglas W Owens
*Assistant Examiner* — Jianzi Chen
(74) *Attorney, Agent, or Firm* — Lin & Associates Intellectual Property, Inc.

(57) ABSTRACT

An LED-based lighting apparatus comprises a rectified AC voltage source having a rectified output connected to a storage capacitor through a switching device, a plurality of LED segments controlled by a linear driving circuit and at least one charging path connected between the LED segments and the storage capacitor. One or more controllable linear LED driving units may be connected in parallel with the storage capacitor to provide balance between reducing flicker and increasing power factor of the lighting apparatus.

15 Claims, 10 Drawing Sheets

(A) (B)

LOW FLICKER LED DRIVING CIRCUIT WITH HIGH POWER FACTOR

BACKGROUND OF THE INVENTION

1. Field of the Invention

The present invention relates generally to a light emitting diode (LED) based lighting apparatus, and more particularly to an LED driving circuit with low flicker and high power factor.

2. Description of Related Arts

LEDs are semiconductor-based light sources often employed in low-power instrumentation and appliance applications for indication purposes in the past. The application of LEDs in various lighting units has also become more and more popular. For example, high brightness LEDs have been widely used for traffic lights, vehicle indicating lights, and braking lights. In recent years, high voltage LED-based lighting apparatus have been developed to replace the conventional incandescent and fluorescent lamps.

In order to increase the brightness of an LED light, a number of LEDs are usually connected in series to form an LED-based lighting string and a number of LED-based lighting strings may further be connected in series to form a lighting apparatus. The operating voltage required by each lighting string typically is related to the forward voltage of the LEDs in each lighting string, how many LEDs are employed for each of the lighting string and how they are interconnected, and how the respective lighting strings are organized to receive power from a power source.

FIG. 1 shows a conventional LED-based lighting unit with a linear driving circuit 102. The LED-based light unit comprises a plurality of LED segments 110, 120 connected in series and controlled by the linear driving circuit 102. For simplicity, FIG. 1 only shows two segments 110 and 120. Each LED segment comprises one or more LEDs 103 connected in series. A rectified AC voltage source 101 provides power to the LED-based lighting unit.

FIG. 2 shows the voltage levels of the input AC voltage and the brightness of the LED-based lighting unit. The linear driving circuit 102 controls the number of segments that are turned on according to the rectified AC voltage. As a result, the brightness of the LED-based lighting unit is proportional to the rectified voltage level of the rectified AC voltage source. As can be seen in FIG. 2, the brightness of the LED-based lighting unit varies according to the variation of the input AC voltage and therefore has high flicker because the brightness changes significantly from zero to its maximum level. Because the rectified AC voltage output is not regulated, the linear driving circuit 102 is simple and requires low cost.

In order to reduce the brightness variation, a storage capacitor 301 as shown in FIG. 3 may be added to the LED-based lighting unit to regulate the voltage level of the rectified AC voltage output to form DC voltage. FIG. 3 also shows the voltage levels of the input AC voltage and the DC voltage after regulation as well as the brightness of the LED-based lighting unit. As can be seen, the lowest brightness of the LED-based lighting unit is increased significantly and the brightness variation is also greatly reduced.

In the conventional LED-based lighting unit shown in FIG. 3, the maximum AC current does not occur at the time when the input AC voltage reaches the maximum voltage level. FIG. 4 shows the values of the input AC voltage and the AC current. It can be seen that the AC current increases abruptly to start the charging phase and then linearly decreases to the discharging phase of the storage capacitor.

During the charging phase, the AC current drives the LEDs and also charges the storage capacitor. During the discharging phase, the LED current is supplied by the storage capacitor. From the waveform of the AC current, it can be seen that the waveform has high harmonic distortion due to the abrupt increase and then linear decrease in the AC current. As a result, the LED-based lighting unit has a low power factor (PF).

SUMMARY OF THE INVENTION

The present invention has been made to provide an LED-based lighting apparatus with low flicker and high power factor. Accordingly, the LED-based lighting apparatus is powered with a rectified AC voltage source in association with at least one charging path between one of the LEDs and a storage capacitor in the lighting apparatus in order to reduce the brightness variation and power loss.

In a preferred embodiment of the present invention, the LED-based lighting apparatus comprises a rectified AC voltage source having a rectified output connected to a storage capacitor through a switching device, a plurality of LED segments controlled by a linear driving circuit and at least one charging path connected between the LED segments and the storage capacitor.

In order to balance between reducing the flicker and increasing the power factor, the present invention further improves the preferred embodiment by connecting at least one controllable linear LED driving unit in parallel with the storage capacitor. When the LED segments controlled by the linear driving circuit do not generate enough instantaneous brightness, the controllable linear LED driving unit can be turned on to increase the brightness and reduce the flicker of the LED-based lighting apparatus.

According to the present invention, each of the charging paths may be connected to the positive node or negative node of an LED in the LED segments. Each charging path may be formed by a variable current source. The charging path may also be formed by a current control device with a switch connected in series. Multiple charging paths may be formed by connecting one current control device to multiple parallel switches that are connected to the positive or negative nodes of LEDs in the LED segments.

BRIEF DESCRIPTION OF THE DRAWINGS

The present invention will be apparent to those skilled in the art by reading the following detailed description of preferred embodiments thereof, with reference to the attached drawings, in which.

DETAILED DESCRIPTION OF THE PREFERRED EMBODIMENT

Figure 1:
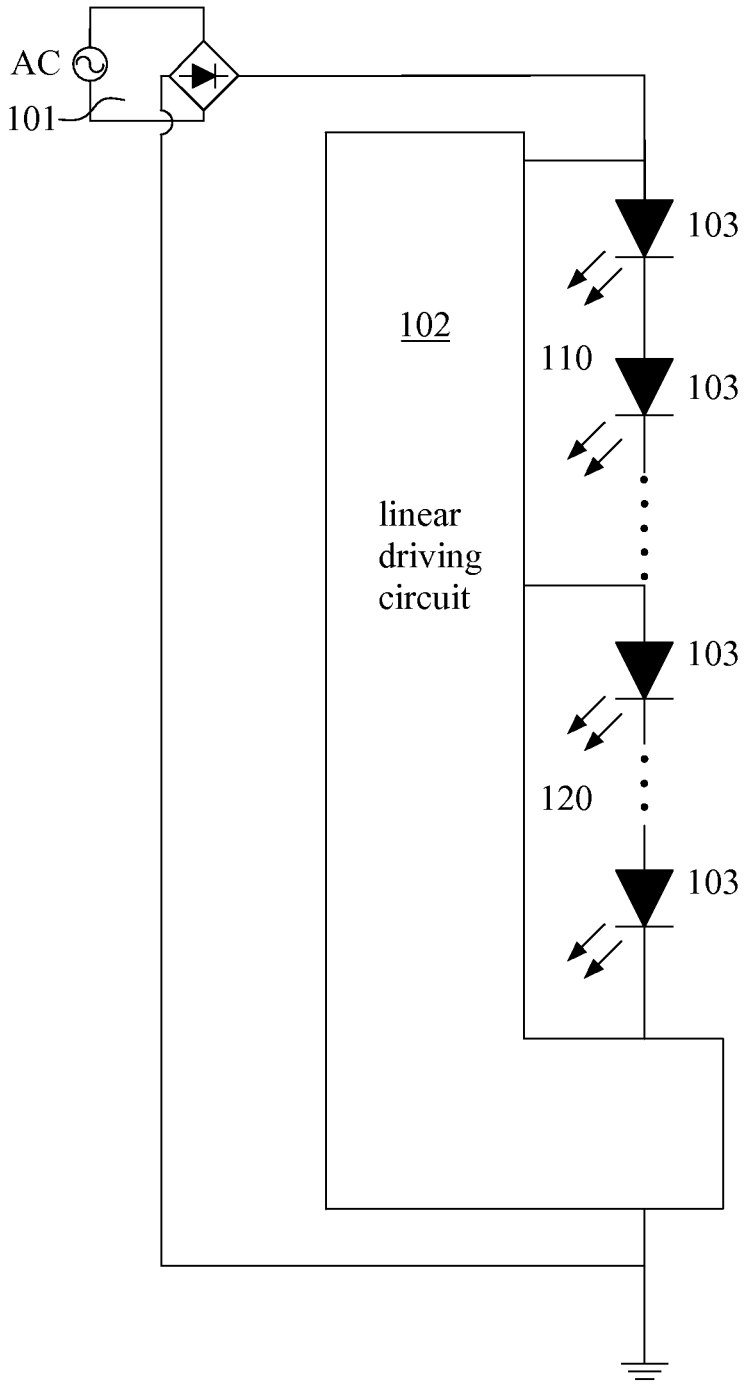
FIG. 1 (PRIOR ART)
FIG. 1 shows a conventional LED-based lighting unit with a linear driving circuit.
Figure 2:
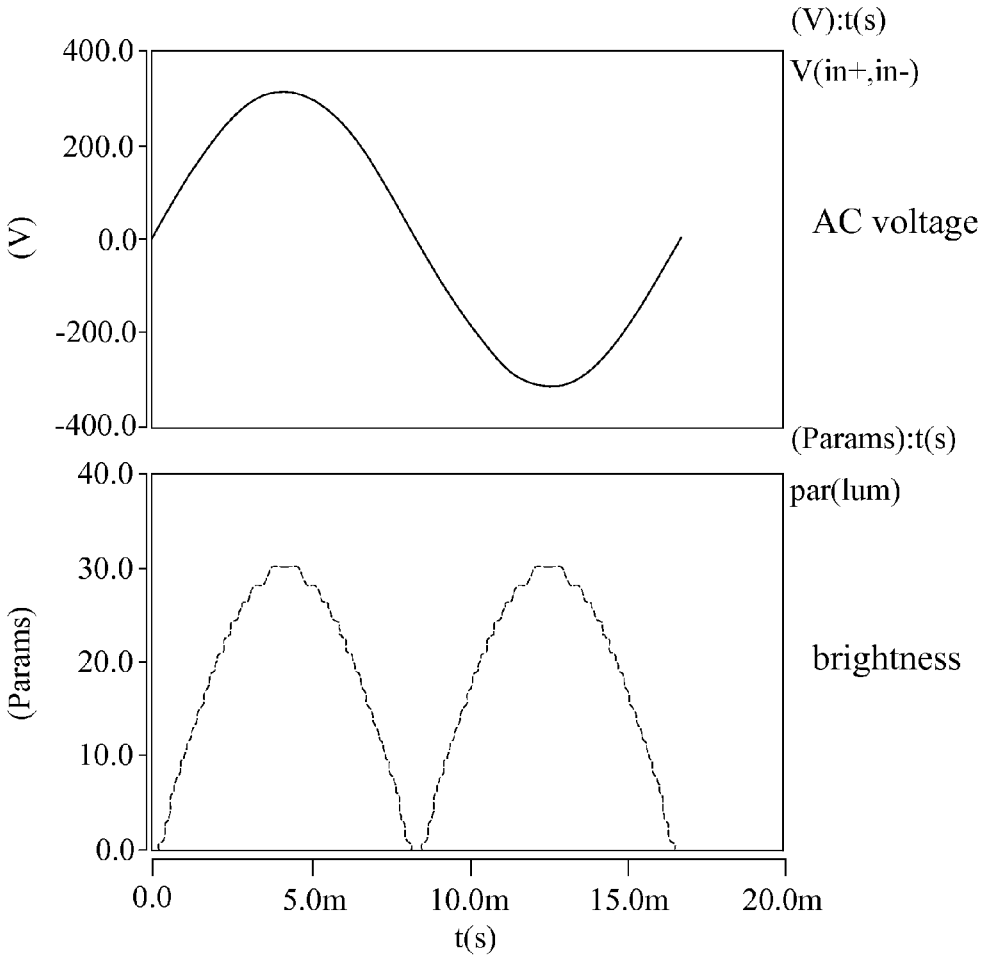
FIG. 2 (PRIOR ART)
FIG. 2 shows the voltage levels of the input AC voltage and the brightness of the LED-based lighting unit.
Figure 3:
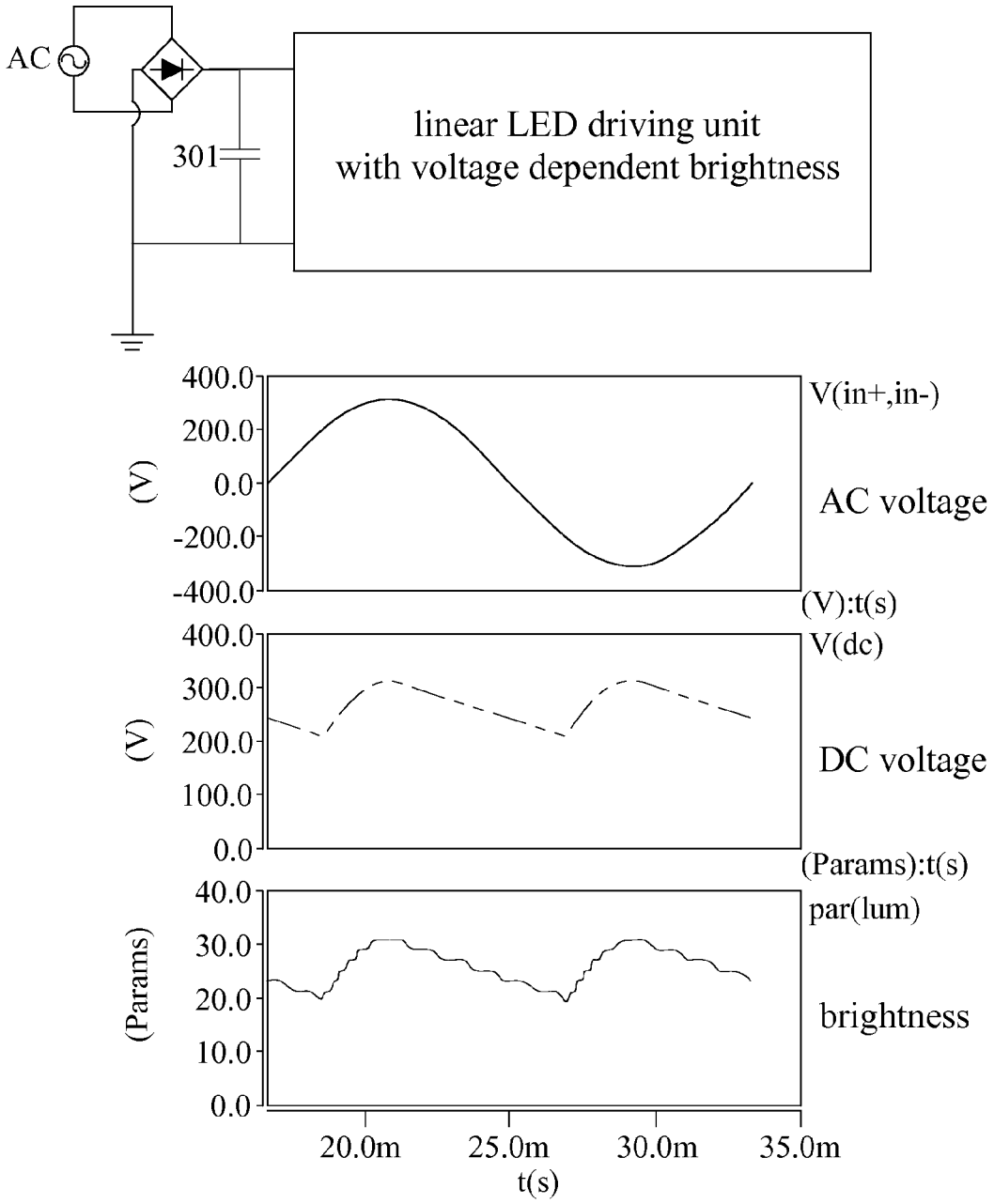
FIG. 3 (PRIOR ART)
FIG. 3 shows a storage capacitor being used to regulate the rectified AC voltage in the linear LED driving unit of FIG. 1 and the voltage levels of the input AC voltage and the DC voltage as well as the brightness of the linear LED driving unit.
Figure 4:
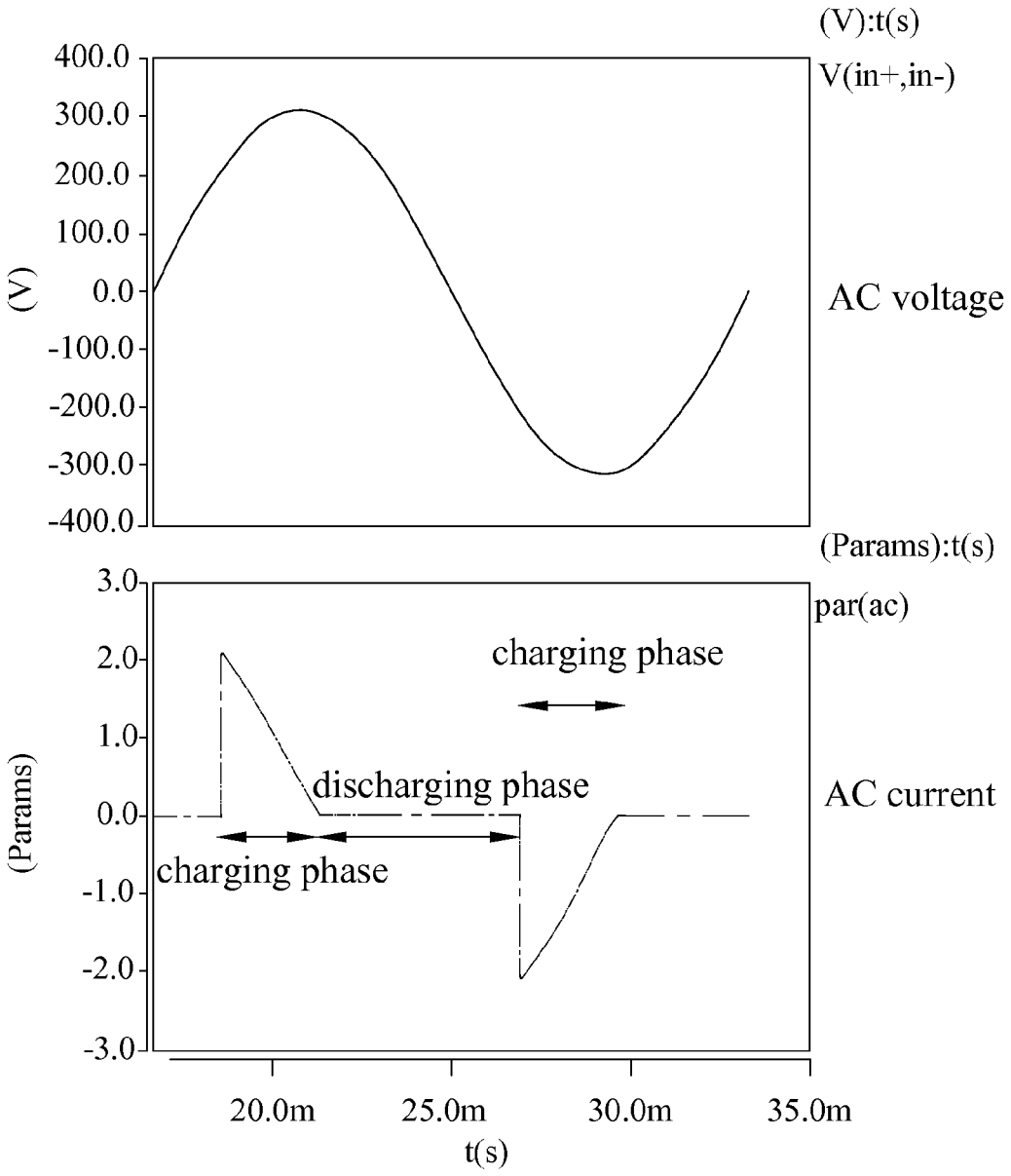
FIG. 4 (PRIOR ART)
FIG. 4 shows the values of the input AC voltage and the AC current of the linear LED driving unit with a storage capacitor.

The accompanying drawings are included to provide a further understanding of the invention, and are incorporated in and constitute a part of this specification. The drawing illustrates embodiments of the invention and, together with the description, serves to explain the principles of the invention.

Figure 5:
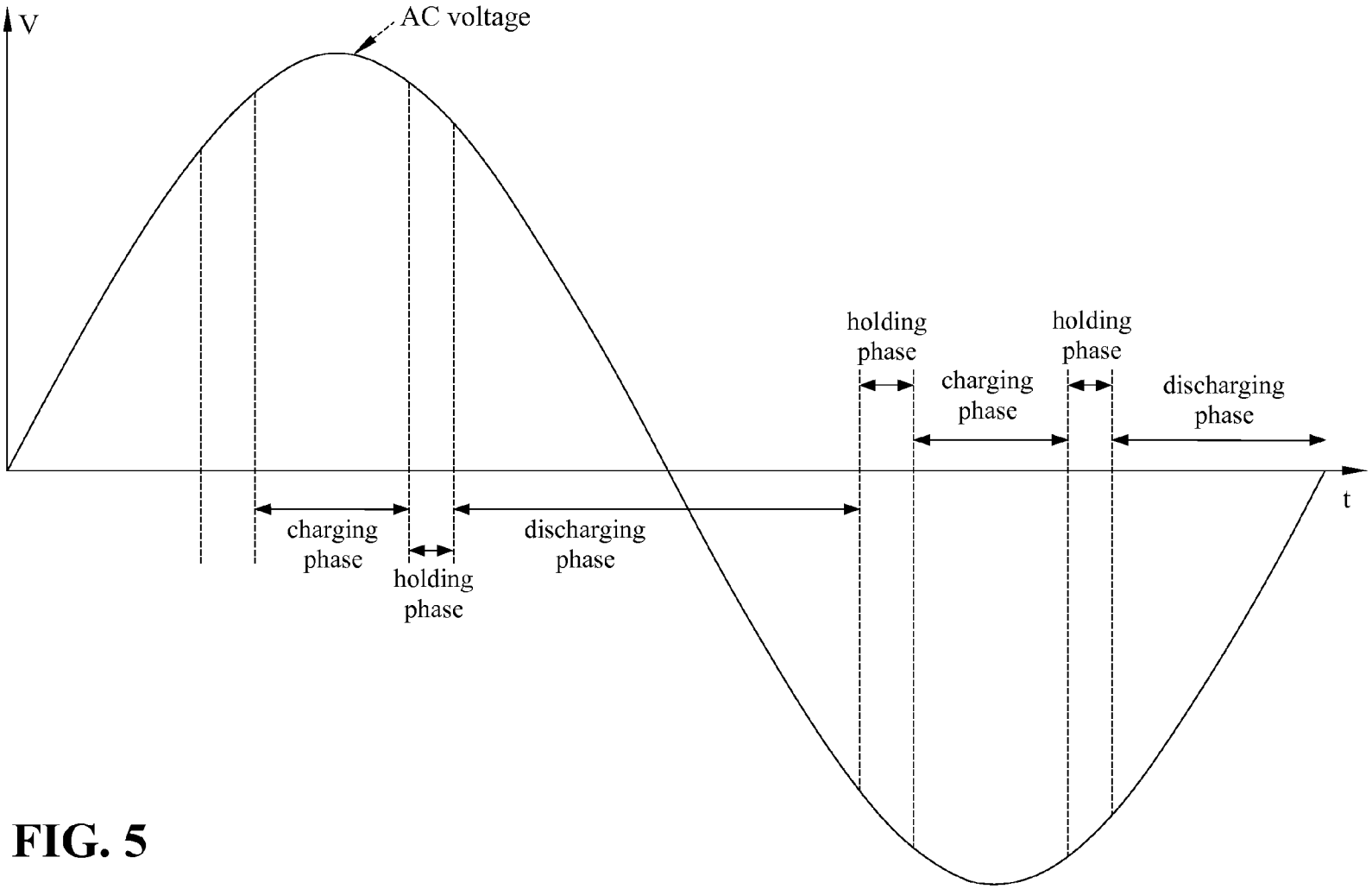
FIG. 5 shows the charging, holding and discharging phases of the LED-based lighting apparatus according to the present invention.

In order to provide a high power factor for the LED-based lighting apparatus, the present invention provides a circuit that can charge the storage capacitor when the input AC voltage is at voltage levels around its peak value. FIG. 5 shows the charging, holding and discharging phases of the LED-based lighting apparatus powered by a rectified AC voltage source.

As shown in FIG. 5, charging phase occurs when the input AC voltage has higher AC voltage to control the charging current of the storage capacitor so as to reduce the harmonic distortions. The AC current drives the LEDs and charges the storage capacitor in the charging phase. During the discharging phase, LED current is supplied by the storage capacitor. During the holding phase, the storage capacitor is neither charged nor dis-charged. The holding phase is optional for better control of the power factor.

Figure 6:
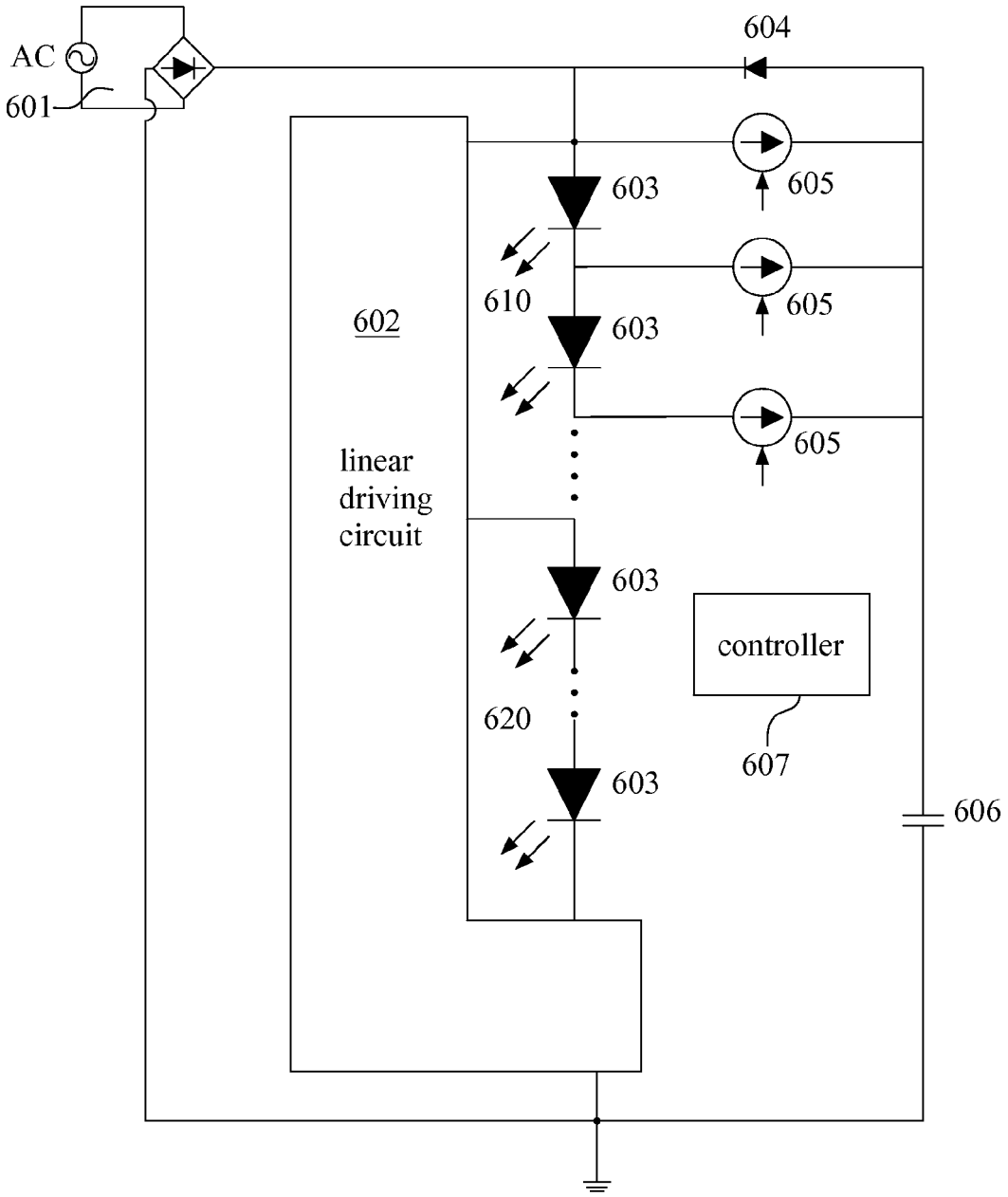
FIG. 6 shows a block diagram of an LED-based lighting apparatus with low flicker and high power factor according to a preferred embodiment of the present invention.

FIG. 6 shows the block diagram of an LED-based lighting apparatus with low flicker and high power factor according to a preferred embodiment of the present invention. In the embodiment, the LED-based light apparatus comprises a plurality of LED segments 610, 620 connected in series and controlled by the linear driving circuit 602. For simplicity, FIG. 6 only shows two segments 610 and 620. Each LED segment comprises one or more LEDs 603 connected in series. A rectified AC voltage source 601 provides power to the LED-based lighting apparatus.

As shown in FIG. 6, the output of the rectified AC voltage source 601 is connected to the positive node of the leading LED 603 in the leading LED segment 610. A switching device 604 couples the output of the rectified AC voltage source 601 to the storage capacitor 606. The LED-based lighting apparatus further comprises at least one variable current source 605 that connects one of the LEDs to the storage capacitor 606. Each variable current source 605 forms a charging path for the storage capacitor 606.

It should be noted that each charging path may be connected to the positive or negative node of an LED 603. The switching device 604 can be a passive switch or an active switch. A diode as shown in FIG. 6 can be used as the switching device 604. When the voltage level at the storage capacitor 606 is higher than the output of the rectified AC voltage source 601, the diode is turned on and the storage capacitor 606 provides current to the LEDs.

As can be seen in FIG. 6, there are three charging paths formed by three variable current sources 605 respectively in this example. A controller 607 controls the three variable current sources 605. The charging paths can be used to control the charging current of the storage capacitor 606 to prolong the charging time so as to increase the power factor. Because the AC voltage level varies during the charging phase, it is necessary to select optimal charging paths in order to reduce the power loss caused by the charging.

Figure 7:
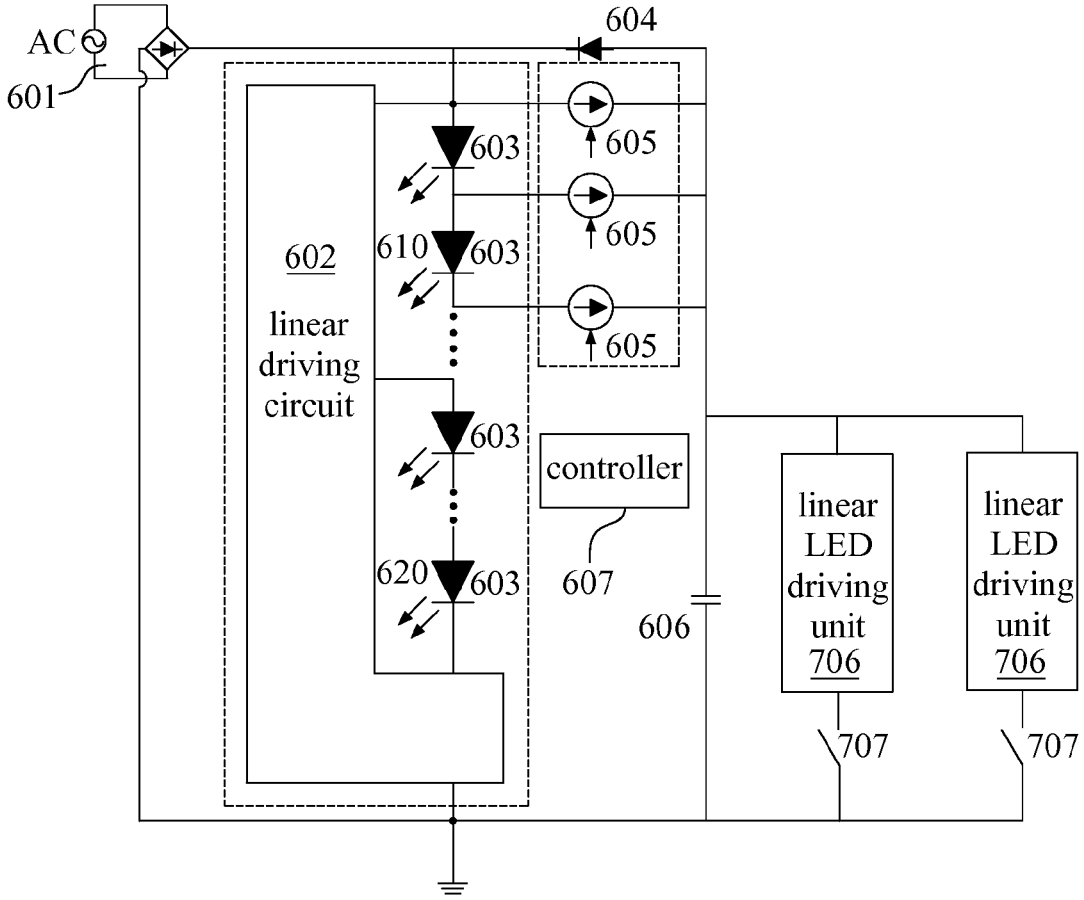
FIG. 7 shows an improvement to the embodiment shown in FIG. 6 by connecting at least one controllable linear LED driving unit in parallel with the storage capacitor.

As can be understood, the flicker can be reduced by prolonging the discharging phase and the power factor can be increased by reducing the harmonic distortion in the waveform of the AC current. However, it is difficult to balance the flicker and power factor in the embodiment shown in FIG. 6. FIG. 7 presents an improvement to the embodiment by connecting at least one controllable linear LED driving unit in parallel with the storage capacitors 606. Each controllable linear LED driving unit is formed by a linear LED driving unit 706 connected in series with a switch 707.

In the improved embodiment shown in FIG. 7, the linear LED driving unit 706 can be turned on when the instantaneous brightness generated by the LEDs 603 is not adequate. The discharging phase can thus be reduced in order to increase the power factor. In addition to being turned on during the discharging phase, the linear LED driving unit 706 can also be used to generate waveform for multi-phase brightness.

Figure 8:
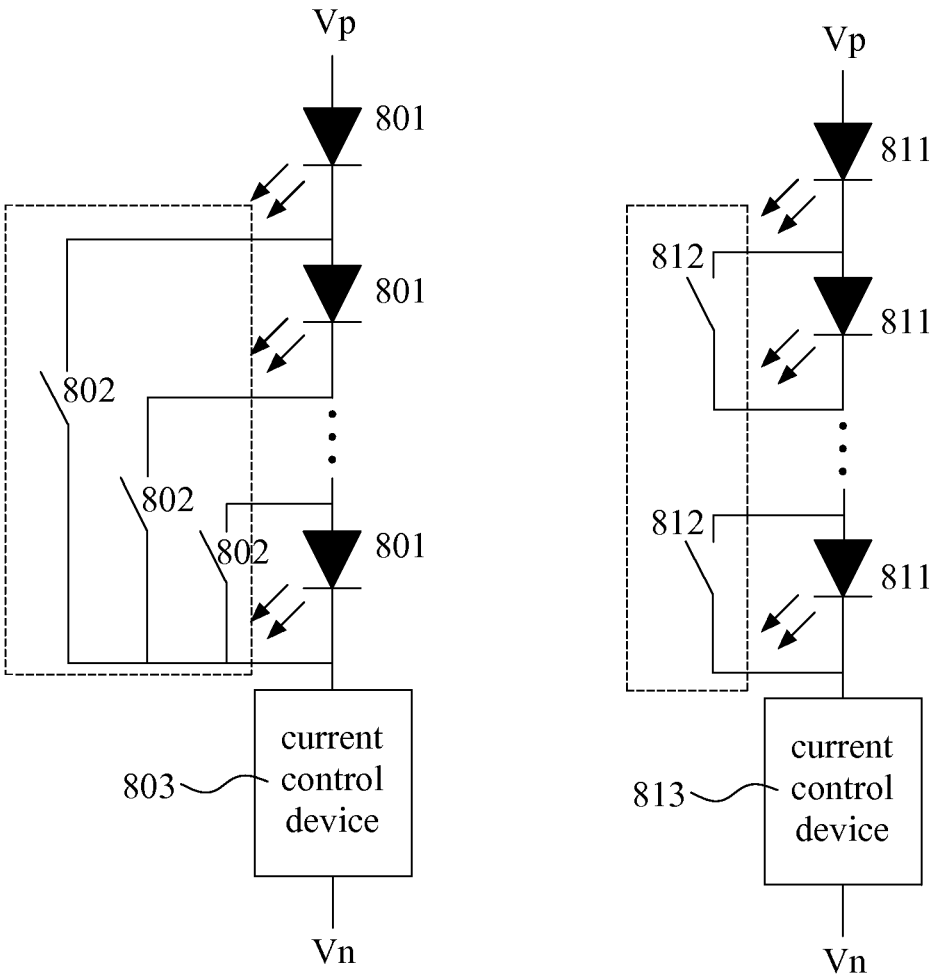
FIG. 8 shows two examples of the linear LED driving unit used to connect in parallel with the storage capacitor in FIG. 7.

FIG. 8 shows two examples of the linear LED driving units 706. In FIG. 8(A), the linear LED driving unit comprises a plurality of LED segments 801 connected in series with a current control device 803. Each LED segment 801 includes one or more LEDs. For simplicity, only one LED is shown in each LED segment 801. Each LED segment 801 has an associated switch 802 connected from its positive end to the current control device 803.

The linear LED driving unit shown in FIG. 8(B) also comprises a plurality of LED segments 811 connected in series with a current control device 813. Each LED segment 811 has an associated switch 812 connected in parallel with the LED segment 811. The associated switches 802 or 812 in the linear LED driving units are optional and their states depend on the voltage difference between voltage Vp at the positive end and voltage Vn at the negative end.

Figure 9:
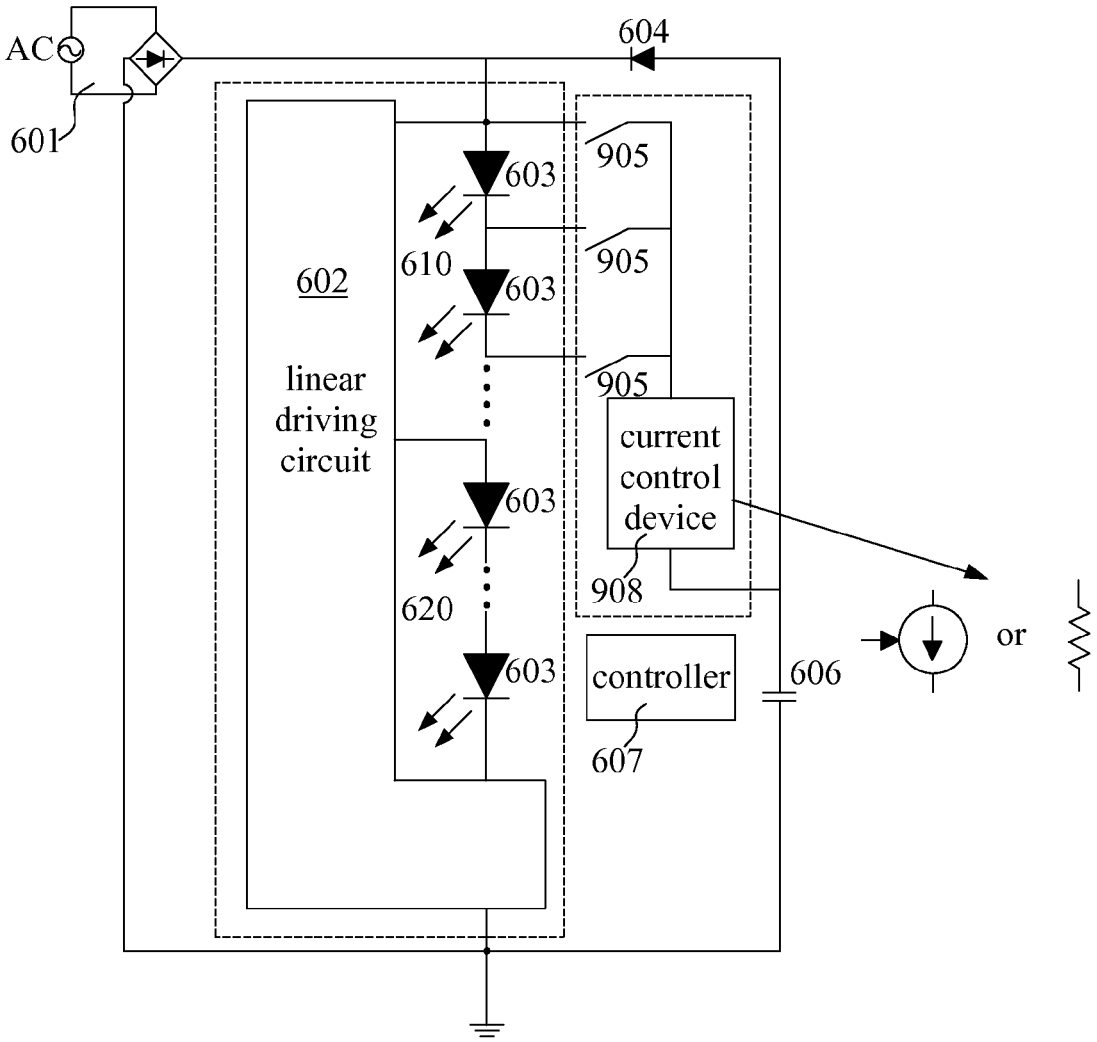
FIG. 9 shows the block diagram of an LED-based lighting apparatus with low flicker and high power factor according to a variation of the preferred embodiment of the present invention shown in FIG. 6.
Figure 10:
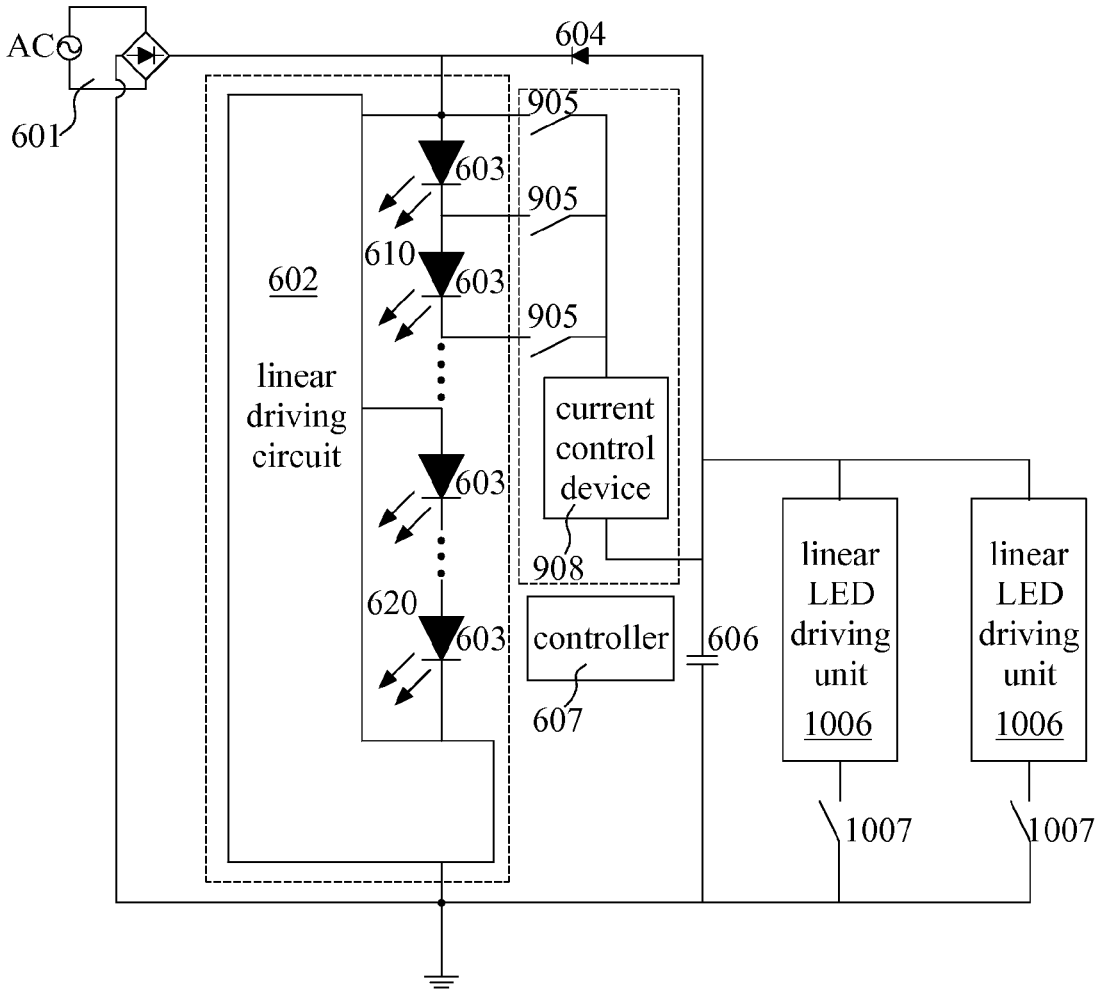
FIG. 10 shows an improvement to the embodiment shown in FIG. 9 by connecting at least one linear LED driving unit in parallel with the storage capacitor.

FIG. 9 shows the block diagram of an LED-based lighting unit with low flicker and high power factor according to a variation of the preferred embodiment of the present invention shown in FIG. 6. As can be seen, the three charging paths formed by three variable current sources 605 in FIG. 6 are replaced by three switches 905 in connection with a current control device 908. The current control device 908 may be a current source or a resistor. To balance the flicker reduction and the power factor increase, one or more controllable linear LED driving units can be connected in parallel with the storage capacitor 606 as shown in FIG. 10. Each controllable linear LED driving unit is formed by a linear LED driving unit 1006 connected in series with a switch 1007.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. An LED-based lighting apparatus, comprising:

a rectified AC voltage source having a rectified output;

a switching device having a negative node connected directly to said rectified output;

a storage capacitor having a positive end connected directly to a positive node of said switching device and a negative end connected directly to ground;

a plurality of LED segments connected in series, each of said plurality of LED segments having one or more LEDs connected in series, and a leading LED of a leading segment of said plurality of LED segments having a positive node connected directly to said rectified output;

a linear driving circuit controlling said plurality of LED segments;

at least one charging path connecting either a positive node or a negative node of one of the LEDs in said plurality of LED segments to said positive end of said storage capacitor; and a controller controlling said at least one charging path;

wherein said storage capacitor, said switching device and said plurality of LED segments form a discharging path for said storage capacitor to provide an LED current through said switching device to said plurality of LED segments.

2. The LED-based lighting apparatus as claimed in claim 1, wherein said switching device is a diode with a positive node connected to said positive end of said storage capacitor and a negative node connected directly to said rectified output.

3. The LED-based lighting apparatus as claimed in claim 1, wherein said switching device is a passive device.

4. The LED-based lighting apparatus as claimed in claim 1, wherein said switching device is an active device.

5. The LED-based lighting apparatus as claimed in claim 1, further comprising at least one controllable linear LED driving unit connected in parallel with said storage capacitor, each controllable linear LED driving unit including a linear LED driving unit connected in series with a switch.

6. The LED-based lighting apparatus as claimed in claim 5, wherein said linear LED driving unit comprises a plurality of LED segments connected in series with a current control device, each of the plurality of LED segments except a leading LED segment in said linear LED driving unit having an associated switch connected in parallel with the associated LED segment.

7. The LED-based lighting apparatus as claimed in claim 5, wherein said linear LED driving unit comprises a plurality of LED segments connected in series with a current control device, each of the plurality of LED segments except a leading LED segment in said linear LED driving unit having an associated switch connected from a positive end of the associated LED segment to a negative end of a trailing LED segment in said linear LED driving unit.

8. The LED-based lighting apparatus as claimed in claim 1, wherein said at least one charging path comprises a variable current source.

9. The LED-based lighting apparatus as claimed in claim 8, wherein said variable current source is connected from said rectified output to said positive end of said storage capacitor.

10. The LED-based lighting apparatus as claimed in claim 1, wherein a first variable current source is connected between the positive node of said leading LED and said positive end of said storage capacitor to form a first charging path, and a second variable current source is connected between the negative node of said leading LED and said positive end of said storage capacitor to form a second charging path.

11. The LED-based lighting apparatus as claimed in claim 1, wherein said at least one charging path comprises a switch connected in series with a current control device.

12. The LED-based lighting apparatus as claimed in claim 11, wherein said current control device is a variable current source.

13. The LED-based lighting apparatus as claimed in claim 11, wherein said current control device is a resistor.

14. The LED-based lighting apparatus as claimed in claim 11, wherein said switch has one end connected to said rectified output and said current control device has one end connect to said positive end of said storage capacitor.

15. The LED-based lighting apparatus as claimed in claim 1, wherein a first switch is connected between the positive node of said leading LED and a first end of a current control device to form a first charging path, and a second switch is connected between the negative node of said leading LED and the first end of said current control device to form a second charging path, said current control device having a second end connected to first positive end of said storage capacitor.

* * * * *